US007904985B2

(12) United States Patent
Hendrickson et al.

(10) Patent No.: US 7,904,985 B2
(45) Date of Patent: Mar. 15, 2011

(54) WASH CYCLES USING OXIDIZING AGENTS AND SENSORS

(75) Inventors: Michael Stephen Hendrickson, St. Joseph, MI (US); Timothy Nicholas Aykroyd, Brookline, MA (US); Tremitchell Wright, Elkhart, IN (US); Joel Adam Luckman, Benton Harbor, MI (US); Colleen M. Doyle, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 721 days.

(21) Appl. No.: 11/745,015

(22) Filed: May 7, 2007

(65) Prior Publication Data

US 2008/0276964 A1 Nov. 13, 2008

(51) Int. Cl.
*D06F 33/02* (2006.01)

(52) U.S. Cl. ..... 8/159

(58) Field of Classification Search ..... 8/158, 159; 68/12.02, 12.18, 12.23, 12.27
See application file for complete search history.

(56) References Cited

U.S. PATENT DOCUMENTS

| | | | | |
|---|---|---|---|---|
| 2,323,993 | A | 7/1943 | Harvey | |
| 2,430,668 | A | 11/1947 | Chamberlin | |
| 2,431,040 | A | 11/1947 | Harvey | |
| 2,540,431 | A | 2/1951 | Davis et al. | |
| 2,762,527 | A | 9/1956 | Manley | |
| 3,095,722 | A | 7/1963 | Fox | |
| 3,268,120 | A | 8/1966 | Durst | |
| 3,347,066 | A | 10/1967 | Klausner | |
| 3,567,076 | A | 3/1971 | Zanussi | |
| 3,702,069 | A | 11/1972 | Sharpe | |
| 3,736,773 | A | 6/1973 | Waugh | |
| 3,982,666 | A | 9/1976 | Kleimola et al. | |
| 3,988,908 | A | 11/1976 | Beare et al. | |
| 4,110,075 | A | 8/1978 | Graf et al. | |
| 4,120,650 | A | 10/1978 | Kappler et al. | |
| 4,188,807 | A | 2/1980 | Graf et al. | |
| 4,503,575 | A | 3/1985 | Knoop et al. | |
| 4,867,193 | A | 9/1989 | Hayashi et al. | |
| 5,014,211 | A | 5/1991 | Turner et al. | |
| 5,230,228 | A * | 7/1993 | Nakano et al. | 68/12.04 |

(Continued)

FOREIGN PATENT DOCUMENTS

| | | |
|---|---|---|
| EP | 0379665 | 8/1990 |

(Continued)

*Primary Examiner* — Joseph L Perrin
(74) *Attorney, Agent, or Firm* — Clifton G. Green; Greer, Burns & Crain Ltd

(57) ABSTRACT

A substrate treating appliance utilizing a plurality of different chemistries for different cycles or different wash loads with a plurality of receptacles for receiving a plurality of cartridges containing the different chemistries. Each receptacle has one half of a lock and key connection arrangement providing a unique interconnection configuration at each receptacle, relative to the remaining receptacles, permitting only a selected type of chemistry cartridge to be accepted at a particular receptacle. A connection effected between the cartridge and the receptacle occurs by rotation of the cartridge relative to the receptacle between an insertion orientation and a locking orientation. Each receptacle is shaped to receive a cylindrical mouth wall of a particular type of chemistry cartridge. Each receptacle may also be uniquely sized, relative to the remaining receptacles, to accept only a selected type of chemistry cartridge. The plurality of receptacles may be arranged adjacent to one another with each cartridge having a configuration that prevents insertion of a cartridge into a receptacle unless every cartridge located in an adjacent receptacle is rotated to the locking orientation.

21 Claims, 4 Drawing Sheets

U.S. PATENT DOCUMENTS

| | | | | |
|---|---|---|---|---|
| 5,297,307 | A | 3/1994 | Baek | |
| 5,739,534 | A * | 4/1998 | Estenson et al. | 250/339.11 |
| 5,870,906 | A | 2/1999 | Denisar | |
| 5,897,671 | A | 4/1999 | Newman et al. | |
| 6,055,831 | A | 5/2000 | Barbe | |
| 6,463,611 | B1 | 10/2002 | Mattia et al. | |
| 6,482,242 | B2 | 11/2002 | Yarmosky | |
| 6,502,265 | B2 | 1/2003 | Blair et al. | |
| 6,553,594 | B2 | 4/2003 | Broker et al. | |
| 6,557,732 | B2 | 5/2003 | Van Rompuy et al. | |
| 6,581,800 | B2 | 6/2003 | Rodd et al. | |
| 6,671,916 | B2 | 1/2004 | Herr et al. | |
| 6,784,997 | B2 * | 8/2004 | Lorenz et al. | 356/429 |
| 6,789,404 | B2 | 9/2004 | Kim et al. | |
| 6,792,637 | B2 | 9/2004 | Reichold et al. | |
| 6,863,798 | B2 | 3/2005 | Nakamura et al. | |
| 6,955,067 | B2 | 10/2005 | Davenet et al. | |
| 7,036,176 | B2 | 5/2006 | Aouad et al. | |
| 7,113,280 | B2 | 9/2006 | Oon et al. | |
| 7,114,209 | B2 | 10/2006 | Metzger-Groom et al. | |
| 7,476,258 | B2 | 1/2009 | Birker et al. | |
| 7,516,629 | B2 | 4/2009 | Behrens et al. | |
| 2001/0049846 | A1 | 12/2001 | Guzzi et al. | |
| 2003/0051296 | A1 | 3/2003 | Broker et al. | |
| 2003/0116177 | A1 | 6/2003 | Appel et al. | |
| 2003/0154560 | A1 | 8/2003 | Behrens et al. | |
| 2003/0213505 | A1 | 11/2003 | Price et al. | |
| 2004/0148708 | A1 | 8/2004 | Stoessel et al. | |
| 2005/0022314 | A1 | 2/2005 | Ambuter et al. | |
| 2005/0144737 | A1 | 7/2005 | Roepke et al. | |
| 2005/0188731 | A1 | 9/2005 | Aouad | |
| 2005/0274157 | A1 | 12/2005 | Yang | |
| 2006/0081016 | A1 | 4/2006 | Hsu et al. | |
| 2006/0107705 | A1 | 5/2006 | Hsu et al. | |
| 2008/0276655 | A1 | 11/2008 | Luckman et al. | |
| 2008/0276964 | A1 | 11/2008 | Hendrickson | |
| 2008/0276965 | A1 | 11/2008 | Aykroyd et al. | |

FOREIGN PATENT DOCUMENTS

| | | |
|---|---|---|
| GB | 1062774 | 3/1967 |
| GB | 2179683 | 3/1987 |
| GB | 2052251 A | 1/1991 |
| GB | 2417492 | 3/2006 |
| JP | 54-112566 | 9/1979 |
| JP | 63-318997 | 12/1988 |
| JP | 3131296 | 6/1991 |
| JP | 04-263898 | 9/1992 |
| JP | 05-345090 | 12/1993 |
| JP | 6-086894 | 3/1994 |
| JP | 06-261995 | 9/1994 |
| JP | 09-056971 | 3/1997 |
| JP | 09-094372 | 4/1997 |
| JP | 11-047486 | 2/1999 |
| JP | 2000-157775 | 6/2000 |
| JP | 2001-008881 | 1/2001 |
| JP | 2002-102582 | 4/2002 |
| WO | 0220893 | 3/2002 |
| WO | 2005058126 | 6/2005 |
| WO | 2006021773 | 3/2006 |

* cited by examiner

| FIG. 1A |
| --- |
| FIG. 1B |

WASH CYCLES USING OXIDIZING AGENTS AND SENSORS

BACKGROUND OF THE INVENTION

In appliances that are used to wash various fabrics, oftentimes different chemistries are added to the appliance during different treatment cycles or at different times during a given treatment cycle, depending on the treatment function to be performed, and depending on the item being treated, for example. It is known to provide different containers containing different chemistries, such that during operation of the appliance, the appropriate chemistries can be selected and introduced to the appliance.

For example, in U.S. Pat. No. 6,691,536, a washing apparatus is provided with various tanks 19, 20, 27 and 28 that can contain selected chemistries for dispensing for different cycles or during different parts of a cycle.

In published application US2006/0107705, a stand-alone dispensing device for laundry care composition is provided with a plurality of containers 40 for selected chemistry products.

Various sensors are utilized to determine the condition of a wash load or wash liquor in disclosures such as US2001/0049846, U.S. Pat. Nos. 6,955,067, 7,114,209 and 7,113,280.

It would be an improvement in the art if there were provided wash cycle that could accept a color of a fabric load and provide a proper selection of chemistries based on at least the color of the fabric load.

SUMMARY OF THE INVENTION

In an embodiment of the invention, a wash cycle is provided which includes the steps:

loading a wash machine with a fabric load for cleaning, selecting a wash cycle based on at least a color of the fabric load, determining a load size and type, dispensing wash water or other aqueous or non-aqueous working fluid into the wash machine to form a wash liquor, sensing water quality of the wash water, determining an amount of detergent to add into the wash liquor and a length of time for the wash liquor to be presented to the wash load based on the previous selecting, determining and sensing steps, determining an amount of oxidizing agent to add into the wash liquor and a time for adding the oxidizing agent to the wash liquor based on the selecting, determining and sensing steps, and performing washing steps of flexing the fabric load in the presence of the wash liquor, rinsing the fabric load and extracting liquid from the fabric load, while dispensing the detergent and oxidizing agent in accordance with the determinations made.

The various steps of loading, selecting, determining dispensing and sensing can occur in many different orders than the order listed.

In an embodiment, the step of selecting a wash cycle based on at least a color of the fabric load includes a step of automatically sensing a color of the fabric load in the wash zone.

In an embodiment, the step of automatically sensing a color of the fabric load includes lighting an interior of the wash zone once the fabric load has been loaded and capturing a digital image of the fabric load In an embodiment, the step of capturing a digital image includes translating pixels of the resultant image into specific red, green and blue components, determining an intensity of each component and combining the determined intensities.

In an embodiment, the step of automatically sensing a color of the fabric load includes lighting an interior of the wash zone once the fabric load has been loaded and scanning the fabric load using selective light filtering.

In an embodiment, a further a step of controlling a pH of the wash liquor during the performing step is included.

In an embodiment, the step of sensing water quality of the wash water comprises sensing at least one of ORP, pH, temperature and turbidity of the wash water. In an embodiment, a further step of sensing quality of the wash liquor during each of the washing steps is included.

In an embodiment, the step of sensing water quality of the wash water comprises sensing at least one of pH, Oxidation Reduction Potential, temperature and turbidity of the wash water.

In an embodiment of the invention, a wash cycle includes the steps:

loading a wash machine with a fabric load for cleaning, selecting a wash cycle based on at least a color of the fabric load, dispensing a wash liquor into the wash machine, determining an amount of detergent to add into the wash liquor and a length of time for the wash liquor to be presented to the wash load based on the selecting step, determining an amount of oxidizing agent to add into the wash liquor and a time for adding the oxidizing agent to the wash liquor based on the selecting step, performing washing steps of recirculating the wash liquor through the fabric load, rinsing the fabric load and extracting liquid from the fabric load, while dispensing the detergent and oxidizing agent in accordance with the determinations made.

DETAILED DESCRIPTION OF THE PREFERRED EMBODIMENTS

Figures 1, 1A:
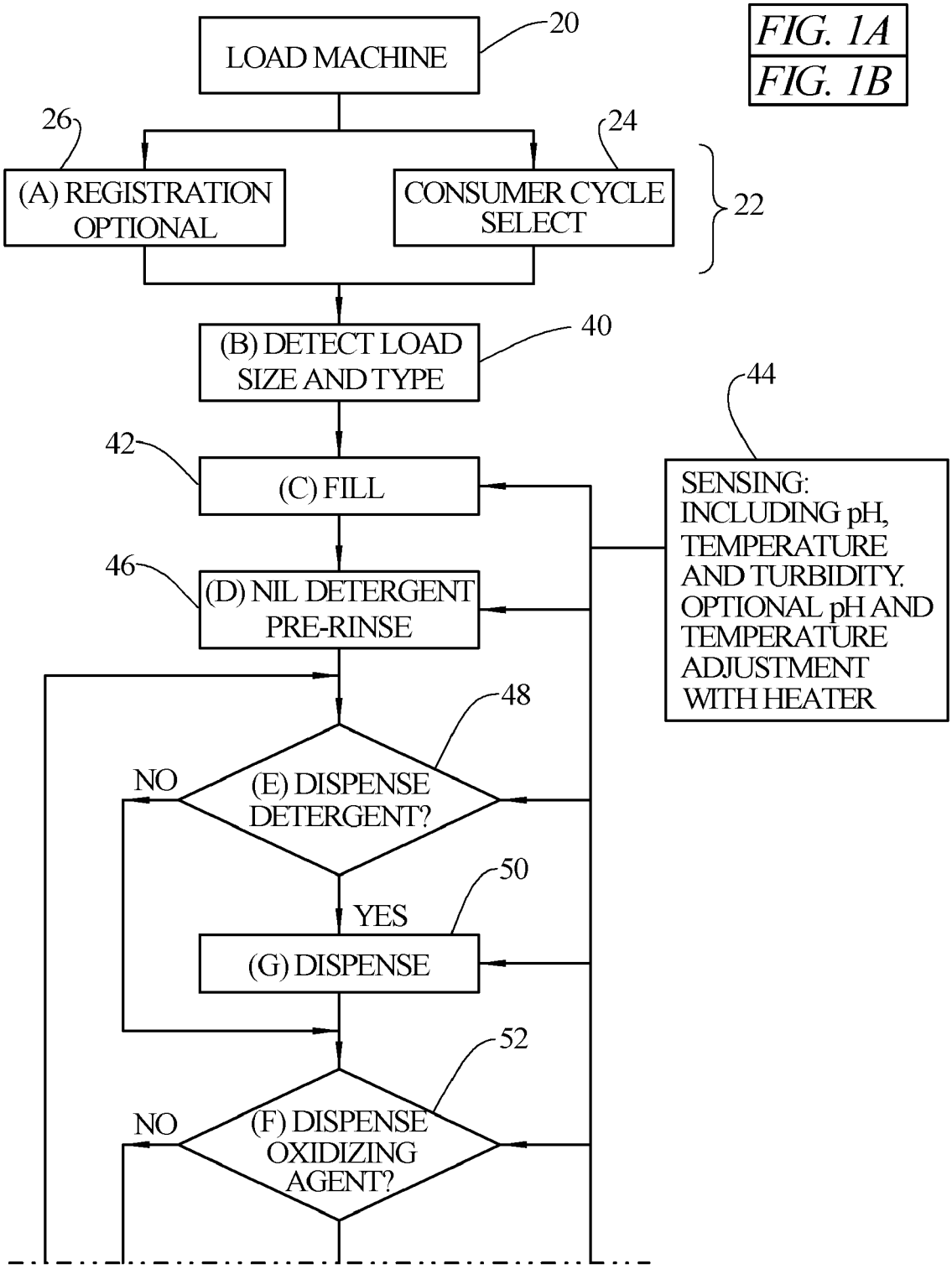
FIG. 1 is a flow chart diagram of a wash cycle embodying the principles of the present invention.
Figure 1B:
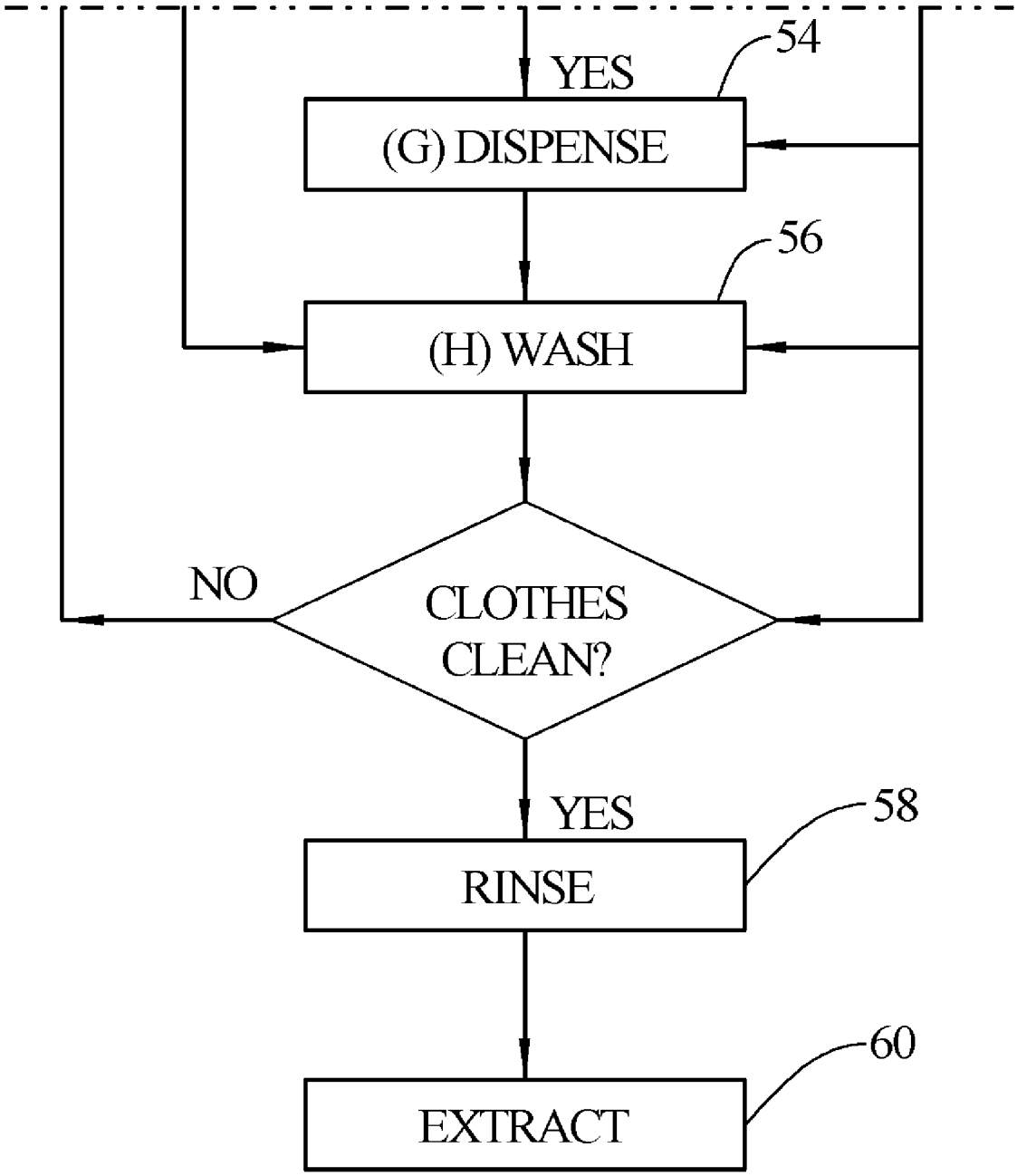

In an embodiment of the invention, as shown in FIG. 1, the present invention provides a wash cycle comprising a plurality of steps.

A step 20 includes loading a wash zone 21 of a wash machine 23 with a fabric load 25 for cleaning. The wash zone 21 may be located in a rotatable drum 27 of a horizontal axis washer, a vertical axis washer, a cabinet, a washer dryer combo, a dryer or a hanging apparatus.

Figure 2:
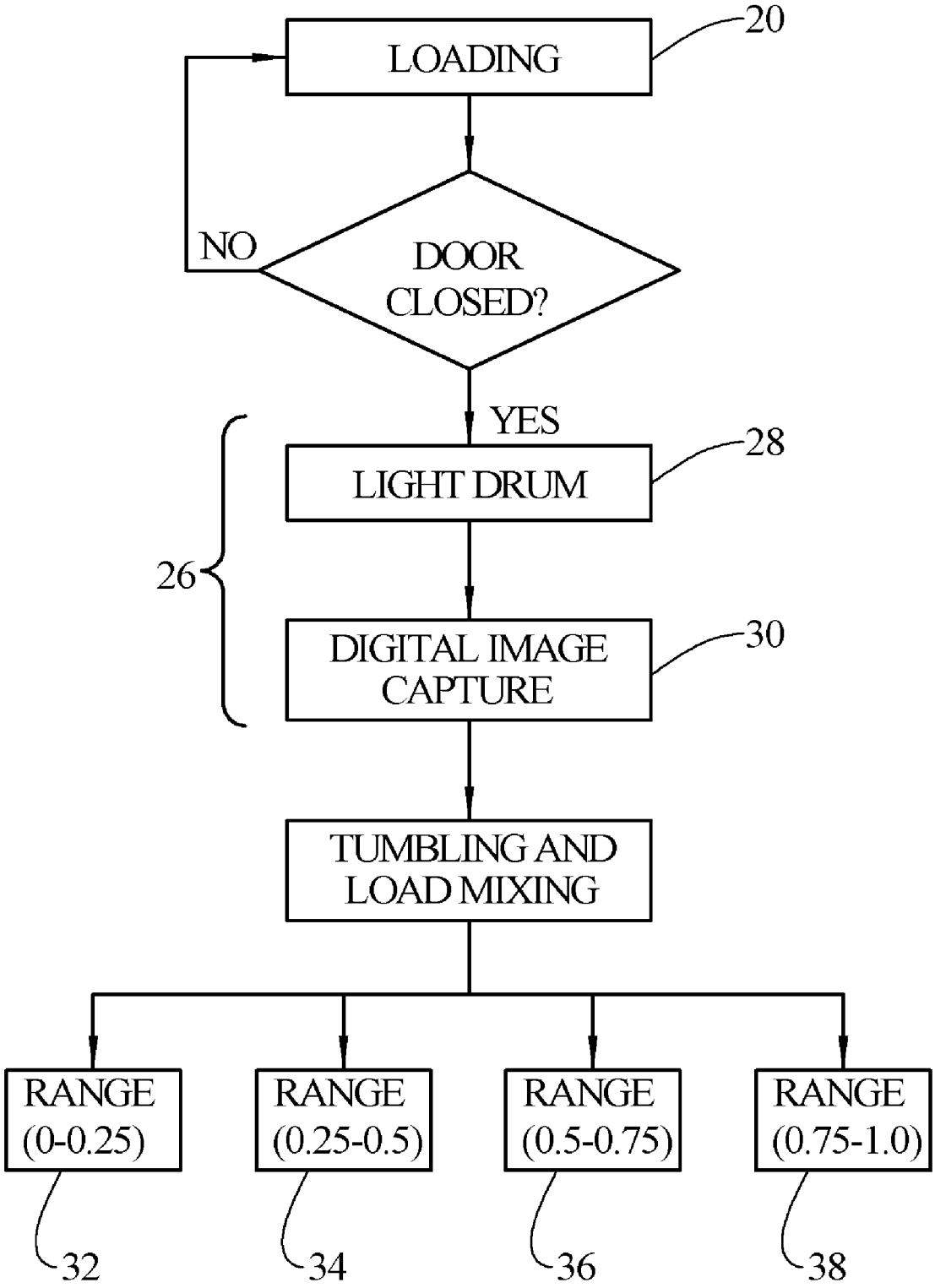
FIG. 2 is a flow chart diagram of a method of selecting a wash cycle based on color, in accordance with the principles of the present invention.
Figure 3:
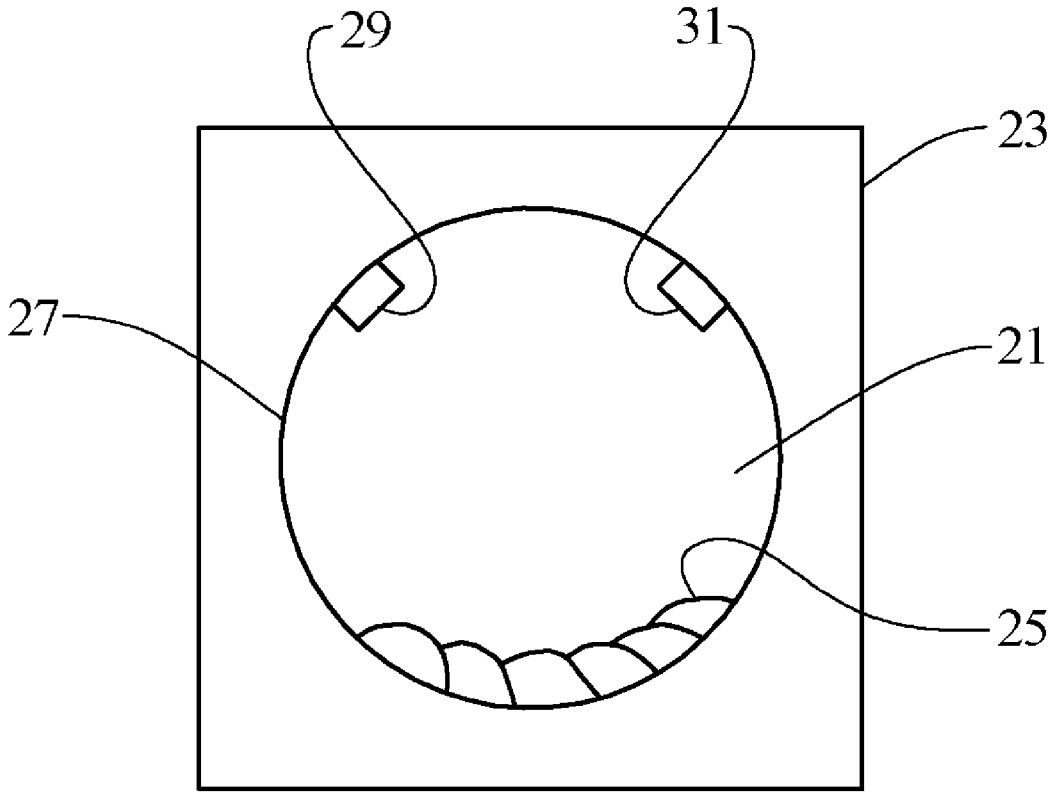
FIG. 3 is a schematic illustration of a wash zone of the wash machine with a digital optical device and an illumination device.

A step 22 includes selecting a wash cycle based on at least a color of the fabric load. The selecting may occur manually, as in step 24, by a user of the machine 23, or it may occur automatically, as in step 26, via components of the machine. For example, the fabric load 25 may include radio frequency identification (RFID) tags which can be read by the machine to distinguish fabric type, size, color and construction. There may be alternative arrangements for automatically determining a color of the fabric load in step 26. One method of determining the color of the fabric load, as shown in FIGS. 2 and 3, would be to illuminate (step 28) the wash zone 21 after the fabric load 25 has been loaded (step 20) with an illumination device 29, such as an incandescent bulb or LEDs, and to capture a digital image (step 30) of the fabric load with a digital camera or other digital optical device 31. The pixels of the resultant image can be translated to the specific red, green and blue components. For each component, the scale of intensity will vary from 0-1. An intensity of 1 would be the most intense. A purely white load would have a low resultant number. The combination of the three numbers can be used by the machine to make a decision on the amount of oxidizing agent or detergent to be added during the wash cycle. In a simple case, ranges from 0-0.25 (step 32), 0.25-0.5 (step 34), 0.5-0.75 (step 36) and 0.75-1.0 (step 38) can be used to determine an amount of chemistry to add or how aggressive the machine should wash in order to protect the fabric. A similar range can be set for the effective emissivity of the fabric material; this information can be coded in the RFID chip.

Selective light filtering, as is used in color copiers, can be used in step 26 to decide the color of the fabric load. A scan is taken by shining light on the material with a filter for red, green and blue. Behind each filter is a sensor or device that can sense the presence or absence of the light. This can then be translated into an intensity or effective emissivity number for each color. Ranges similar to those described above can then be used to make a decision on chemistry dispensing. The system may use a weighted average to determine the overall intensity and emissivity of the load as garments are added. Based on this information the system could provide the user with feedback on the color of the load. The value of the intensity or effective emissivity may be communicated in consumer language such as lights, whites, brights, darks and blacks.

When a white or light colored fabric load is detected, care can be taken, via the chemistries added or not added, to not add color through dye bleeding. Also, the color detection can be used to look for large items that weren't sorted properly, such as a light/dark mix, or the inclusion of certain specific fabric types that should be washed differently, such as wool. When a white or light fabric load is detected, the dosage of oxidizing agent used in the oxidizing agent wash liquor can be increased. For non-white color loads, the temperature of the wash liquor can be lowered and more anti-redeposition agents can be added to the wash liquor. When a wool fabric is detected, the oxidizing agents can be prevented from entering the wash liquor. As shown in FIG. 1, a step 40 includes determining a load size and type. This can be accomplished via a user input on a user interface device on the machine. Alternatively, the machine may automatically determine the load size and type. This may be accomplished via motor sense detection or through specific fill algorithms, as is known in the art.

A step 42 includes dispensing wash water or some other aqueous or non-aqueous working fluid into the wash machine to form a wash liquor in a fluid state, such as liquid, gas, vapor, foam, etc. In some embodiments, the working fluid is water, a non-aqueous wash liquor, a vapor, a foam, a structured liquid or a gel may be used, so this step would not always include the dispensing of water. Although water or wash fluid is used in most of the examples, it can be substituted for any of the working fluids or combination thereof. As the water is dispensed into the wash machine, a step 44 of sensing water quality will occur. Sensors located in the washing machine are used to detect water quality in terms of parameters such as turbidity, conductivity, pH, ORP, dissolved oxygen, metals ions and organics. One or more of these parameters may be used in making a determination in a later step of the amount of detergents and oxidizing agents to be added to the wash liquor.

A step 46 of pre-rinsing the fabric load may be undertaken before any detergent chemistries are added to the water in some cycles. The pre-rinsing setting can be used to add a dye fixer in the case of a dark load or a black load. The dye fixer can be added to the pre-wash chamber in the current dispenser system or a unit dose added from an auto dose system or poured in the wash basket. Continued sensing of the type noted in step 44 could be conducted during this pre-rinsing step 46 as well.

A step 48 includes determining a type and amount of detergent chemistry to add (if any) into the wash liquor and a length of time for the wash liquor to be presented to the wash load based on the selecting 22, determining 40 and sensing steps 44. The oxidizing agents to be added to the wash zone are active oxygen releasing compounds, e.g., peroxides (peroxygen compounds) such as perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, and the like. These agents also include peroxy acids and organic peroxides and various mixtures thereof.

A peroxy acid is an acid in which an acidic —OH group has been replaced by an —OOH group. They are formed chiefly by elements in groups 14, 15 and 16 of the periodic table, but boron and certain transition elements are also known to form peroxy acids. Sulfur and phosphorus form the largest range of peroxy acids, including some condensed forms such as peroxydiphosphoric acid, $H_4P_2O_8$ and peroxydisulfuric acid, $H_2S_2O_8$. This term also includes compounds such as peroxycarboxylic acids and meta-chloroperoxybenzoic_acid (mCPBA).

Organic peroxides are organic compounds containing the peroxide functional group (ROOR'). If the R' is hydrogen, the compound is called an organic hydroperoxide. Peresters have general structure RC(O)OOR. The O—O bond easily breaks and forms free radicals of the form RO—. This makes organic peroxides useful for cleaning purposes.

There are four possible descriptions of the oxidizing agent product composition based on concentration. "Ultra concentrated" means that 80 to 100% of the bleach is active. "Concentrated" means that 40 to 79% of the bleach is active. "Bleach with additive" means that 20-40% of the bleach is active. "Cleaning product with bleach" means that less than 25% of the bleach is active.

Oxidizing agents may be combined within a mixture that has a selection of other material, such as one or more of the following: builders, surfactants, enzymes, bleach activators, bleach catalysts, bleach boosters, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, water soluble polymers, water swellable polymers and mixtures thereof.

A particular oxidizing agent to be added to form the oxidizing agent wash liquor could comprise a combination of water with one or more of sodium carbonate, sodium percarbonate, surfactants and enzymes.

The detergent chemistries to be selected from may include surfactants, emulsifiers, enzyme activated stain removers, sudsing agents, builders, anti-redeposition polymers and perfumes. These chemistries may be premixed, or may be provided from separate containers. In addition to the type of chemistries to be added, and the amounts, the timing of the dispensing (step 50) of the detergent chemistries and the length of time that these chemistries are to remain in contact with the fabric load can be determined. This determination may be made in advance, or may be determined as the wash process occurs, such as through the continuous sensing of the wash liquor, for example to determine if proteins are being removed from the fabric load via enzyme action.

A step 52 includes determining an amount of oxidizing agent to add (if any) into the wash liquor and a time for adding (54) the oxidizing agent to the wash liquor based on the selecting 22, determining 40 and sensing 44 steps. The oxidizing agent may be in the form of a premade powder or liquid, or the oxidizing agent may be generated by the machine, as is known, and added to the wash liquor upon generation. Again, the type and amount of oxidizing agent to add into the wash liquor can be determined based on the various parameters. The timing for when the oxidizing agent is added is also determined, which may be based on initial selected 22, determined 40 or sensed 44 parameters, or may be based on parameters sensed 44 during the wash process. In some fabric loads, or stain or treatment conditions, the addition of an oxidizing agent too early might deactivate certain detergent chemistries, such as enzyme detergents, before the enzymes have had sufficient time to remove various stains. In other loads or conditions, it may be beneficial to have a longer contact period between the fabric load and the oxidizing agents, and the detergent chemistries may not be negatively affected by the introduction of the oxidizing agents. The amount of oxidizing agent added may be in the range of 0.1-40% hydrogen peroxide equivalent, preferably 0.1 to 20%, and most preferably 0.1 to 10%. However, if the load is white or heavily stained, the preferred level of oxidizing agent is in the range of 1 to 30% and most preferred 10-30% hydrogen peroxide equivalent. These ranges can also be measured using an ORP sensor that can be calibrated to these concentrations. If the sensor detects that the concentrations are out of range for a particular color range, then the system can undertake an action to correct the level. The correction can be a combination of dilution or neutralization.

A step 56 includes performing washing steps of flexing the fabric load in the presence of the wash liquor, rinsing the fabric load (step 58) and extracting liquid (step 60) from the fabric load, while dispensing the detergent and oxidizing agent in accordance with the determinations made. Some of the washing steps may include contact between the fabric load and the wash liquor without flexing of the fabric load, perhaps with recirculation and reapplication of the wash liquor onto the fabric load. This may occur, for example, by rotating the drum defining the wash zone to urge the fabric load towards the drum, or even to hold the fabric load against the drum, collecting any wash liquor which is not retained in absorption by the fabric load, and reapplying the wash liquor to the fabric load, such as by spraying the wash liquor against the rotating fabric load. In other washing steps, the fabric load may be flexed via tumbling, agitating, or other known methods of flexing fabric.

The washing steps may occur in different wash liquors at different times during the wash cycle, and the different wash liquors may be derived by successively adding chemistries to the wash liquor, or by draining one wash liquor and reintroducing a completely different wash liquor.

During each of the steps of the wash cycle, from when the wash water is first added to the wash zone (step 42), and including each of the cycles or portions of a cycle while the fabric load is in contact with the wash liquor, sensing of the wash liquor can occur, in order to determine a current condition of one or more of the parameters of pH, temperature and turbidity of the wash liquor. Various adjustments to each of these parameters can be effected, such as by adjusting the pH of the wash liquor to keep in within a certain desired range for a given chemistry application, or within a certain temperature range to increase the effectiveness of a certain chemistry application. Also the turbidity of the wash liquor can be monitored to determine whether the wash liquor needs to be filtered or replaced with cleaner wash liquor.

The dispensing of the chemistries for the detergent and the oxidizing agents can be done through automatic dispensing chambers, such as mini-bulk, bulk or cartridges, in the form of liquids, solids or gases or vapors.

The pH of the wash liquor can be controlled in ranges from 0-7 and 7-14, and preferably in the ranges of 3-7 and 7-12. In some cycles, the pH range could be controlled to between 6-11. For a gentle cycle with wool or similar materials, the machine can be arranged to control the pH in the range of 6.5 to 7.5. The pH can be controlled by using electrolytic water, adding an acid or a base. The acid or alkali can be selected from the classes of organic and non-organic compounds. This can include glycolic acid, silicafluorides, hydrofluosilic acid, citric acid, acetic acid, and laundry sours. Laundry alkali can include but is not limited to bicarbonates, carbonates, silicates, metasilicates, polysilicates and hydroxides. The pH can also be used in the rinse, preferably the final rinse, to restore the initial color of the garment. The pH control, temperature control and color sensing can be used in combination with dispensing of oxidizing agents and detergent to optimize the wash.

The data gathered about the color of the fabric load can also be used to control the drying step in machines that are washer/dryer combinations or machines that have the ability to communicate with one another. If the measuring system indicates that the load is dark or black, the drying temperature is selected such that the maximum garment temperature does not exceed 120 F, preferably 110 F and most preferably 100 F.

The wash unit can have a special cycle that the consumer can select or de-select that is labeled "color care" or some similar wording covering this concept.

Various features and steps of the wash cycle have been described which may be incorporated singly or in various combinations into a desired wash cycle, even though only certain combinations are described herein. The described combinations should not be viewed in a limiting way, but only as illustrative examples of particular possible combinations of features.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of washing a fabric load in a wash zone of a wash machine comprising the steps:

selecting a wash cycle based on at least an automatically sensed color of the fabric load including:

lighting an interior of the wash zone once the fabric load has been loaded and capturing a digital image of the fabric load, translating pixels of the resultant image into specific red, green and blue components, determining an intensity of each component, dispensing a wash liquor into the wash machine, determining an amount of detergent to add into the wash liquor and a length of time for the wash liquor to be presented to the wash load based on the determined intensities, determining an amount of oxidizing agent to add into the wash liquor and a time for adding the oxidizing agent to the wash liquor based on the determined intensities, performing washing steps of recirculating the wash liquor through the fabric load, rinsing the fabric load and extracting liquid from the fabric load, while dispensing the detergent and oxidizing agent in accordance with the determinations made.

2. The method of claim 1, wherein the determined intensity of each component is measured in a scale of 0 to 1 and ranges for 0-0.25, 0.25-0.5, 0.5-0.75, and 0.75-1.0 are used to determine the amounts of detergent and oxidizing agent to be added to the wash liquor.

3. The method of claim 1, including the steps of determining a load size and type and sensing a quality of the wash liquor, and wherein the steps of determining an amount of detergent to add and determining an amount of oxidizing agent to add are based on the selecting, determining and sensing steps.

4. The method of claim 1, further including a step of controlling at least one of the pH and ORP of the wash liquor during the performing step.

5. The method of claim 1, further including a step of sensing a quality of the wash liquor by sensing at least one of pH, ORP, temperature, conductivity and turbidity of the wash liquor.

6. The method of claim 1, including a step of sensing a quality of the wash liquor during each of the washing steps.

7. The method of claim 6, wherein the step of sensing quality of the wash liquor comprises sensing at least one of pH, ORP, temperature, conductivity and turbidity of the wash liquor.

8. A method of washing a fabric load in a wash zone of a wash machine comprising the steps:

selecting a wash cycle based on at least an automatically sensed color of the fabric load including:

illuminating an interior of the wash zone once the fabric load has been loaded separately with a red, green and blue light, scanning the fabric load separately for each of the red, green and blue illuminations, determining an intensity of each scanned color, dispensing a wash liquor into the wash machine, determining an amount of detergent to add into the wash liquor and a length of time for the wash liquor to be presented to the wash load based on the determined intensities, determining an amount of oxidizing agent to add into the wash liquor and a time for adding the oxidizing agent to the wash liquor based on the determined intensities, performing washing steps of recirculating the wash liquor through the fabric load, rinsing the fabric load and extracting liquid from the fabric load, while dispensing the detergent and oxidizing agent in accordance with the determinations made.

9. The method of claim 8, wherein the determined intensity of each component is measured in a scale of 0 to 1 and ranges for 0-0.25, 0.25-0.5, 0.5-0.75, and 0.75-1.0 are used to determine the amounts of detergent and oxidizing agent to be added to the wash liquor.

10. The method of claim 8, including the steps of determining a load size and type and sensing a quality of the wash liquor, and wherein the steps of determining an amount of detergent to add and determining an amount of oxidizing agent to add are based on the selecting, determining and sensing steps.

11. The method of claim 8, further including a step of controlling at least one of the pH and ORP of the wash liquor during the performing step.

12. The method of claim 8, further including a step of sensing a quality of the wash liquor by sensing at least one of pH, ORP, temperature, conductivity and turbidity of the wash liquor.

13. The method of claim 8, including a step of sensing a quality of the wash liquor during each of the washing steps.

14. The method of claim 13, wherein the step of sensing a quality of the wash liquor comprises sensing at least one of pH, ORP, temperature, conductivity and turbidity of the wash liquor.

15. A method of washing a fabric load in a wash zone of a wash machine comprising the steps:

selecting a wash cycle based on at least an automatically sensed color of the fabric load including:

illuminating an interior of the wash zone once the fabric load has been loaded, determining a separate intensity of for each of red, blue and green colors in the fabric load, dispensing a wash liquor into the wash machine, determining an amount of detergent to add into the wash liquor and a length of time for the wash liquor to be presented to the wash load based on the determined intensities, determining an amount of oxidizing agent to add into the wash liquor and a time for adding the oxidizing agent to the wash liquor based on the determined intensities, performing washing steps of recirculating the wash liquor through the fabric load, rinsing the fabric load and extracting liquid from the fabric load, while dispensing the detergent and oxidizing agent in accordance with the determinations made.

16. The method of claim 15, wherein the determined intensity of each component is measured in a scale of 0 to 1 and ranges for 0-0.25, 0.25-0.5, 0.5-0.75, and 0.75-1.0 are used to determine the amounts of detergent and oxidizing agent to be added to the wash liquor.

17. The method of claim 15, including the steps of determining a load size and type and sensing a quality of the wash liquor, and wherein the steps of determining an amount of detergent to add and determining an amount of oxidizing agent to add are based on the selecting, determining and sensing steps.

18. The method of claim 15, further including a step of controlling at least one of the pH and ORP of the wash liquor during the performing step.

19. The method of claim 15, further including a step of sensing a quality of the wash liquor by sensing at least one of pH, ORP, temperature, conductivity and turbidity of the wash liquor.

20. The method of claim 15, including a step of sensing a quality of the wash liquor during each of the washing steps.

21. The method of claim 20, wherein the step of sensing a quality of the wash liquor comprises sensing at least one of pH, ORP, temperature, conductivity and turbidity of the wash liquor.

* * * * *